United States Patent [19]

Fagan

[11] 4,010,306

[45] Mar. 1, 1977

[54] PROCESSES FOR IMPREGNATING AND COATING TRIAXIAL WEAVE FABRICS

[75] Inventor: Joseph P. Fagan, Huntington, Conn.

[73] Assignee: E. I. Du Pont de Nemours and Company, Wilmington, Del.

[22] Filed: June 2, 1975

[21] Appl. No.: 582,792

[52] U.S. Cl. ..... 428/236; 156/176; 428/246; 428/257; 428/260; 428/272; 428/286; 428/335; 428/340

[51] Int. Cl.² ..... B05D 7/22

[58] Field of Search ..... 428/233, 236, 246, 247, 428/252, 265, 286, 290, 296, 297, 302, 257

[56] References Cited

UNITED STATES PATENTS

| | | | |
|---|---|---|---|
| 2,266,940 | 12/1941 | Traylor | 428/257 |
| 2,598,090 | 5/1952 | Yung et al. | 428/257 |
| 2,682,484 | 6/1954 | Thomas | 428/247 |
| 2,787,570 | 4/1957 | Lott et al. | 428/257 X |
| 2,857,654 | 10/1958 | Sexton | 28/80 |
| 2,942,327 | 6/1960 | Corry | 28/80 |
| 3,328,226 | 6/1967 | Wiley | 428/265 X |
| 3,341,394 | 9/1967 | Kinney | 156/167 X |
| 3,554,852 | 1/1971 | Sugarman et al. | 428/236 |
| 3,904,455 | 9/1975 | Goldman | 156/62.4 |
| R28,155 | 9/1974 | Dow | 139/383 R |

*Primary Examiner*—P.E. Willis, Jr.

[57] ABSTRACT

An improvement in processes for impregnating and coating triaxial weave fabrics is provided. The improvement is laminating a lightweight sheet structure based on continuous filament synthetic organic fiber to the triaxial weave fabric and then impregnating and coating the laminate with a polymeric film using known techniques.

2 Claims, No Drawings

PROCESSES FOR IMPREGNATING AND COATING TRIAXIAL WEAVE FABRICS

FIELD OF THE INVENTION

This invention relates to processes for impregnating and coating triaxial weave fabric with polymeric film and, more particularly, to an improvement in these processes.

PRIOR ART

Impregnation and coating of various biaxial fabrics with a variety of resins and elastomers is well known in the art. Such coated fabrics have been sold commercially for many years and have many uses. However, such coated fabrics have an inherent weakness on the bias which can lead to insufficient physical properties for many end-use applications. For example, tear and tear propagation resistance are physical properties which generally can be inadequate. At low coating weights, these coated fabrics may have good tear but poor bias strength. At high coating weights, the coated fabric may have improved bias strength but poor tear. To achieve a balance of these properties, it has heretofore been necessary to laminate multiple plies oriented at different angles.

Triaxial fabrics are described in U.S. Pat. No. 3,446,251 issued May 27, 1969 to Norris F. Dow. The stated resistance to shear of these fabrics is said to be a desirable property for many end-use applications including their use as a reinforcing fabric in plastics. However, there does not appear to be much difference in isotropic strength of uncoated triaxial fabrics when compared to uncoated biaxial fabrics of similar construction and weight. It has been discovered by Edward L. Yuan, as disclosed in U.S. Application Ser. No. 357,774, that a triaxial weave fabric having a polymeric coating on the surface produces a coated fabric having unexpectedly high average tongue-tear resistance and tensile strength. Unfortunately, the known processes for coating fabrics are not useful for coating lightweight triaxial weaves. A lightweight fabric is one which weighs two ounces or less per square yard. Problems arise with the lightweight triaxial weave fabrics because (1) they have poor dimensional stability under tension, (2) they do not offer a planar surface for process equipment, (3) they have large, open interstitial areas which are difficult to fill or cover with a coating, and (4) the unrestrained fabric has little resistance to curling or distortion while handling. In order to coat these lightweight fabrics, and to prevent curling, costly and sophisticated web handling hardware must be used. All these problems are solved by laminating a lightweight sheet structure based on continuous filament synthetic organic fiber to the lightweight triaxial weave fabric prior to impregnating and coating.

SUMMARY OF THE INVENTION

According to the present invention, there is provided an improvement in processes for impregnating and coating triaxial weave fabrics with polymeric films; the improvement comprising: laminating a lightweight sheet structure based on continuous filament synthetic organic fiber to a triaxial weave fabric and then impregnating and coating the laminate with a polymeric film.

DETAILED DESCRIPTION OF THE INVENTION

The triaxial weave fabrics used in this invention are described in U.S. Pat. No. 3,446,251, the disclosure of which is hereby incorporated by reference. These fabrics have three angularly displaced sets of parallel courses of yarns, woven so as to prevent slippage of at least one yarn course set along any other yarn course set. By varying the openness of the weave, slippage of all three yarn course sets can be varied or prevented.

The yarns used in the triaxial weave fabrics can be made of any material commonly used in fiber manufacture, for example, cotton, wool, polyester, glass, polyamide, aromatic polyamide, rayon or blends thereof, particularly polyester-cotton blends; however, glass and polyester (such as polyethylene terephthalate) are used in many applications. Fabric weight will depend upon the material used and the density of the weave. While this improvement in the coating process is utilizable on all weights of triaxial weave fabrics, its effect is most pronounced when a lightweight fabric is used. A lightweight fabric is one which weighs two ounces/-square yard or less. The preferred yarns for lightweight fabrics include glass, polyester, polyamide and aromatic aramide. Most preferred is aromatic aramide yarn because of its high strength per weight.

Lightweight sheet structures based on continuous filament synthetic organic fiber are well known in the art. An example of such a structure is disclosed in U.S. Pat. No. 3,341,394, issued to G. A. Kinney on Sept. 12, 1967; this patent is hereby incorporated by reference.

The sheet structure is a nonwoven material which is either spunbond, mechanically bond, or resin bond.

The nonwoven material consists of more than one type of fiber, i.e., a binder fiber and a structure fiber. These fibers melt at different temperatures. Binder fibers may consist of continuous filament of a similar chemical nature to the structural filament element but having a lower melting temperature. In one mode of operation, the binder filament may be of the same chemical composition as the structural filament but spun with a lower level of orientation or with no orientation. In a second mode of operation, the co-spun binder filaments may be highly oriented but may be of a copolymeric nature or have some other modification which provides a lower melting temperature than the structural filament. Preferred fibers are polyester and polypropylene. Preferred binder fibers for use with poly(hexamethylene adipamide) include polycaproamide filaments or copolymers, melt blends, etc., thereof with poly(hexamethylene adipamide). Preferred binder fibers for use with poly(ethylene terephthalate) include the isophthalate and hexahydroterephthalate copolymers thereof.

The nonwoven material useful in this invention has a weight of no more than 1.2 ounces/square yard and a thickness of no more than 10 mil, preferably a weight of no more than 0.5 ounces/square yard and a thickness of no more than 3 mil.

The sheet structure is heat pressed or laminated to the triaxial fabric at the temperature at which the fiber having the lower melting temperatures melts.

Any polymeric composition can be used to impregnate and coat the triaxial weave fabric as long as the physical properties which give a useful product are met at a reasonable coating weight. Examples of useful polymeric compositions include polychloroprene, chlorosulfonated polyethylene (Hypalon sold by E. I. du Pont de Nemours and Company), urethane, and polyvinylchloride. The impregnating and coating stages of this process can be by conventional techniques known in the art. Conventional coating techniques include dipping, brushing, and spraying, but most often the fabrics will be coated by dipping in a polymeric dispersion and then doctoring the dispersion to give the desired coating weight. After the polymeric dispersion is coated upon the fabric, the polymer may be cured.

These coated fabrics can be used wherever coated fabrics have heretofore been used.

Laminated articles can be prepared from the coated fabrics by known techniques. This is usually accomplished simply by layering the desired materials and then applying heat and pressure sufficient to adhere the layers. The coated fabrics themselves can be laminated to a desired thickness or one or more layers of coated fabrics can be bonded to at least one other substrate.

The following Example is illustrative of the invention.

EXAMPLE 1

A lightweight coated triaxial weave fabric is prepared as follows:

A spunwoven polyester sheet weighing .7 ounce/-square yard ("Reemay" sold by E. I. du Pont de Nemours and Company) is laminated, in a Rotocure at 175° C., to a polyethylene terephthalate triaxial fabric (2.0 ounces/square yard).

The laminate is impregnated and coated by dipping it into a solution of 25% thermoplastic urethane latex (No. 1023 Urethane Latex sold by Wyandotte Chemical) and thoroughly saturating it. The impregnated fabric is wiped with No. 30 wire rods to remove excess resin dispersion on the fabric. The impregnated fabric is dried in an oven for 10 minutes at 120° C. and then is consolidated in a press at 160° C. and 200 lbs./in.$^2$ pressure for five minutes.

The process produces a lightweight coated triaxial fabric which is substantially free of distortion and curl.

I claim:

1. In a process for impregnating and coating a triaxial weave fabric with a polymeric composition, the improvement comprising: laminating a lightweight nonwoven sheet structure based on continuous filament synthetic organic fiber to the triaxial weave fabric and then impregnating and coating the resulting laminate with the polymeric composition; wherein the triaxial weave fabric is of a yarn of the groups of glass, polyester, polyamide, or aromatic aramide and weighs no more than about two ounces per square yard; the sheet structure is of a yarn selected from the group of polyester or polypropylene and weighs no more than about 0.5 ounces per square yard and has a thickness of no more than about 3 mils; and the polymeric composition is from the group of polychloroprene, chlorosulfonated polyethylene, polyurethane, or polyvinylchloride.

2. A laminate consisting of: lightweight nonwoven sheet structure based on continuous filament synthetic organic fiber, laminated to a triaxial weave fabric; being impregnated and coated with a polymeric composition, wherein the triaxial weave fabric is selected from the group of glass, polyester, plyamide, or aromatic aramide; and weighs no more than about two ounces per square yard;

the sheet structure is of a yarn selected from the group of polyester or polypropylene, and weighs no more than about 0.5 ounces per square yard and has a thickness of no more than about 3 mil; and the polymeric composition is selected from the group of polychloroprene, chlorosulfonated polyethylene, polyurethane, or polyvinylchloride.

* * * * *